US007312387B1

(12) United States Patent
Shaw

(10) Patent No.: US 7,312,387 B1
(45) Date of Patent: Dec. 25, 2007

(54) MUSICAL INSTRUMENT PLECTRUM

(76) Inventor: Eric D. Shaw, 6 Kristina La., Mashpee, MA (US) 02649

( * ) Notice: Subject to any disclaimer, the term of this patent is extended or adjusted under 35 U.S.C. 154(b) by 78 days.

(21) Appl. No.: 11/261,854

(22) Filed: Oct. 28, 2005

(51) Int. Cl.
*G10D 13/16* (2006.01)

(52) U.S. Cl. ..... 84/320

(58) Field of Classification Search ..... 84/320–321, 84/322
See application file for complete search history.

(56) References Cited

U.S. PATENT DOCUMENTS

| | | | | |
|---|---|---|---|---|
| 1,117,056 | A | 11/1914 | Knackstedt | |
| 1,184,561 | A | 5/1916 | Napoletano | |
| 1,254,577 | A | 1/1918 | Carpenter et al. | |
| 1,573,912 | A | 2/1926 | Burdwise | |
| 2,170,179 | A | 8/1939 | Wolcott | |
| 3,319,505 | A | 5/1967 | Galetzky | |
| 3,735,663 | A | 5/1973 | Cowell, Sr. | |
| 4,711,150 | A | 12/1987 | Hyduck | |
| 4,993,302 | A | 2/1991 | Jonathan | |
| 5,271,308 | A | 12/1993 | Balog | |
| 5,859,377 | A | 1/1999 | Mackey et al. | |
| 5,894,097 | A | 4/1999 | Barry | |
| 6,346,662 | B1 | 2/2002 | Sielaff | |
| 6,417,431 | B1 | 7/2002 | Wilkinson | |
| D519,149 | S * | 4/2006 | Ball | D17/20 |
| 7,145,066 | B1 * | 12/2006 | Moreland | 84/320 |
| 2001/0046559 | A1 * | 11/2001 | Hewitson | 427/256 |
| 2002/0108483 | A1 | 8/2002 | Smith | |
| 2005/0092159 | A1 * | 5/2005 | Oskorep | 84/322 |

* cited by examiner

*Primary Examiner*—Kimberly Lockett
(74) *Attorney, Agent, or Firm*—John P. McGonagle

(57) ABSTRACT

A shaped pick with a siliconized acrylic adhesive coating providing a tacky pick surface for the musician's thumb and finger to grip.

9 Claims, 6 Drawing Sheets

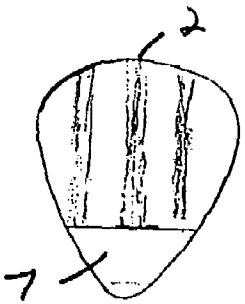
FIG. 13A
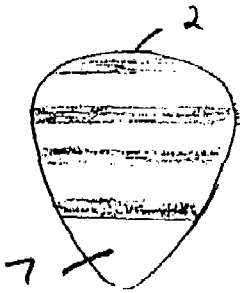
FIG. 13B
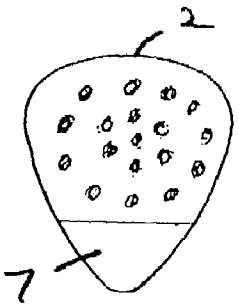
FIG. 13C
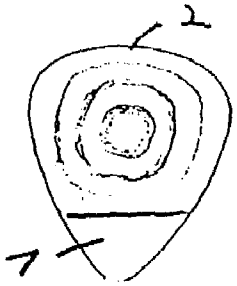
FIG. 13D
FIG. 13E
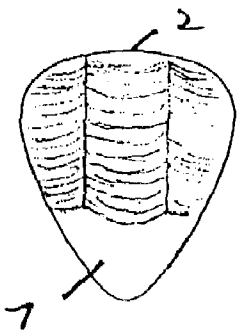
FIG 14
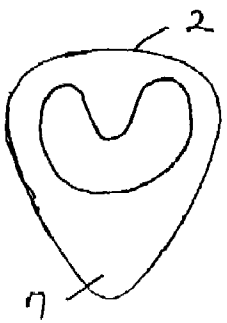
FIG. 13F

MUSICAL INSTRUMENT PLECTRUM

BACKGROUND OF THE INVENTION

This invention relates to plectrums, commonly referred to as picks, that are used in plucking the strings of musical instruments. More specifically, the invention relates to a pick with an improved grip.

Hand-held picks are used for plucking or strumming the strings of musical instruments, such as, but not limited to, guitars, banjos, ukuleles and mandolins. Picks are typically thin, pieces of metal, hard plastic, bone, or other material that most commonly vary in size and having a surface area ranging from the size of a dime to a silver dollar coin. Picks can be flexible, somewhat flexible, or rigid. The pick is most commonly held between the thumb and index finger for plucking or strumming strings. The pick is generally made from materials varying in thickness, hardness and flexibility which directly influences their sound qualities. Most picks have one or more protruding or pointed areas in their outside edges, creating a picking "tip." The pick is usually positioned so that the picking tip protrudes generally beyond the tip of the index finger for easy and accurate contact with individual strings of the musical instrument being played.

One of the single biggest problems musicians find when using a pick is the problem of gripping the pick for any length of time. As a musician plays the stringed instrument, the musician's fingers may become moist with perspiration making prolonged gripping of the hard surface of a pick difficult. The undesired result is that the pick may slide back and forth losing its ideal position between the thumb and forefinger or the pick might even be dropped. The musician's control of the pick affects the way the instrument is played and, ultimately, affect the musician's ability to concentrate on the music he or she is playing.

Many picks have been developed in an attempt to remedy the problem. Some picks have cork or rubber attached to the flat sides to improve grip. However, this solution makes the pick merely texturized and thicker without making it significantly easier to control. Other picks have had finger and/or thumb receiving indentations provided on the pick's sides. While these solutions have been helpful to a degree, none have completely eliminated the problem of the pick slipping from the player's grip.

Accordingly, a primary object of the invention is to prevent or minimize the tendency of a pick to shift relative to the holding or controlling fingers and thumb when the musician is playing an instrument.

SUMMARY OF THE INVENTION

The disclosed pick provides a shaped pick with a coating providing a tacky pick surface for the musician's thumb and finger to grip. The disclosed picks with the invention tacky surface provide improved gripping mechanics for the musician. The coating on the pick substantially reduces slip during pick use.

Applicant has found that coating the pick surfaces with a synthetic polymer adhesive, such as a caulk or double sided adhesive tape, provides a residual tacky surface that survives the polymer setting period. Adhesive in a caulk form is designed to be more flexible, thereby having greater elasticity. Elasticity is that property of a material where the material can be deformed under stress and return to its original shape. The adhesive characteristics of the polymer holds the coating to the pick surfaces even under the stresses of pick use by a musician. The residual tacky surface and elasticity of the coating opposite to the coating surface directly attached to the pick surface provides the musician with an improved pick grip.

Synthetic polymer adhesives are made from one of four base polymers: latex, silicone, polurethane or rubber. Latex adhesives are primarily comprised of acrylics and are very resistant to degradation, i.e., oxidation, ultraviolet light, etc., has good to excellent flexibility and elasticity, and has inherently good adhesion qualities. All latex adhesives can be painted. Silicone adhesives bond well to almost everything. However, silicone adhesives are generally hard to smooth and do not hold paint well. Polyurethane adhesives are tear resistant and stick reliably to almost anything. Polyurethane adhesives are not naturally ultraviolet resistant. Synthetic rubber adhesives will stick to almost everything. However, rubber adhesives tend to smell and suffer shrinkage after being applied.

Of the four base polymers, acrylic adhesives are substantially less expensive than the other three base polymers. Acrylic polymers also have a substantially shorter curing time than the other polymer bases. Strength and flexibility of acrylic adhesives may be improved by adding a small quantity of silicone to the acrylic resulting in a siliconized acrylic adhesive. Because of the overall characteristics of siliconized acrylic adhesives and their low cost, a siliconized acrylic adhesive is the preferred coating for the present invention. However, any of the other three polymers may also be used for the coating. Applicant has also found that a combination of a siliconized acrylic adhesive with a silicone elastomer such as sold in the medical community under the name, COSMESIL, is very effective.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

BRIEF DESCRIPTION OF THE DRAWINGS

FIG. 13A is a surface view of a pick with a textural embodiment comprising vertical ridges.

FIG. 13B is a surface view of a pick with a textural embodiment comprising horizontal ridges.

FIG. 13C is a surface view of a pick with a textural embodiment comprising dot elevations.

FIG. 13D is a surface view of a pick with a textural embodiment comprising concentric circular ridges.

FIG. 13E is a surface view of a pick with a tear drop shaped coating area.

FIG. 13F is a surface view of a pick with a U-shaped coating area.

FIG. 14 (*o*) is a thumb surface view with two vertical ridges.

DETAILED DESCRIPTION OF THE INVENTION

Figure 1:
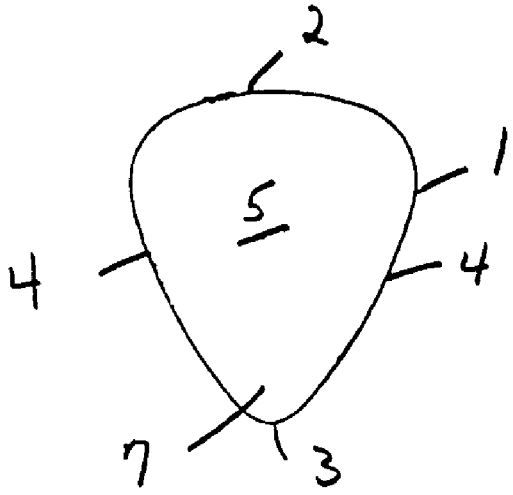
FIG. 1 is a front surface view of a typical, flat, tear-drop shaped pick.
Figure 2:
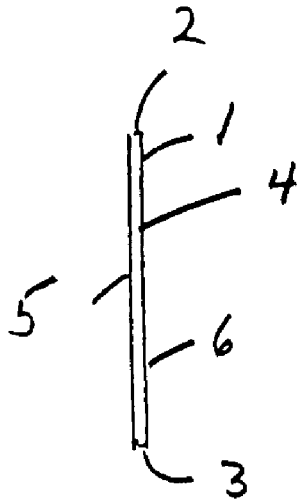
FIG. 2 is a side edge view thereof.

Referring to the drawings in detail wherein like elements are indicated by like numerals, there is shown particularly in FIGS. 1A and 1B, a typical conventional pick 1 comprised of a top edge 2, bottom edge 3, two opposite side edges 4, a flat front (thumb) surface 5, and an opposite flat rear (index finger) surface 6, said front and rear surfaces being identical. The index finger 20 presses against the flat rear surface 6 and the thumb 21 presses against the flat front surface 5. The top edge 2 and bottom edge 3 define a pick longitudinal axis. The opposite side edges 4 taper toward the bottom edge 3 at an acute angle forming a pick tip 7. The opposite side edges 4 expand toward the top edge 2 at an obtuse angle.

Figure 6A:
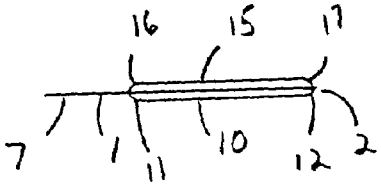
FIG. 6A is a side view of a flat pick embodiment constructed according to the principles of the present invention.
Figure 6B:
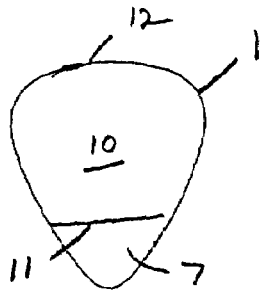
FIG. 6B is a front surface view thereof.
Figure 6C:
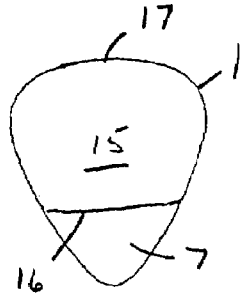
FIG. 6C is a rear surface view thereof.

Referring more particularly to FIGS. 6A-6C, there is shown a pick with a coating 8 on a portion of the front and rear surfaces 5, 6, said coated portions referred to as the thumb gripping surface 10 and the index finger gripping surface 15, respectively. The thumb gripping surface 10 in this particular example extends horizontally from side edge 4 to side edge 4. The thumb gripping surface 10 also extends vertically from a proximal horizontal line 11 adjacent the pick tip 7 to a distal line 12 at the pick top edge 2. The index finger gripping surface 15 extends horizontally from side edge 4 to side edge 4. The index finger gripping surface 15 also extends vertically from a distal horizontal line 16 adjacent the pick tip 7 to a proximal line 17 at the pick top edge 2. In one embodiment of the invention the coating 8 in liquid form is applied to each of the gripping surfaces 10, 15 and allowed to "cure", thereby becoming a solid permanently attached to the surfaces. The coating is non-toxic when cured. Curing permanently attaches the coating to the pick surfaces while maintaining a persistent and renewable tackiness quality. The perspiration from a musician's fingers while playing can actually reactivate the tackiness quality of the coating 8. The tackiness quality of the coating 8 improves a musician's grip on the pick and is what makes this invention unique.

Figure 3:
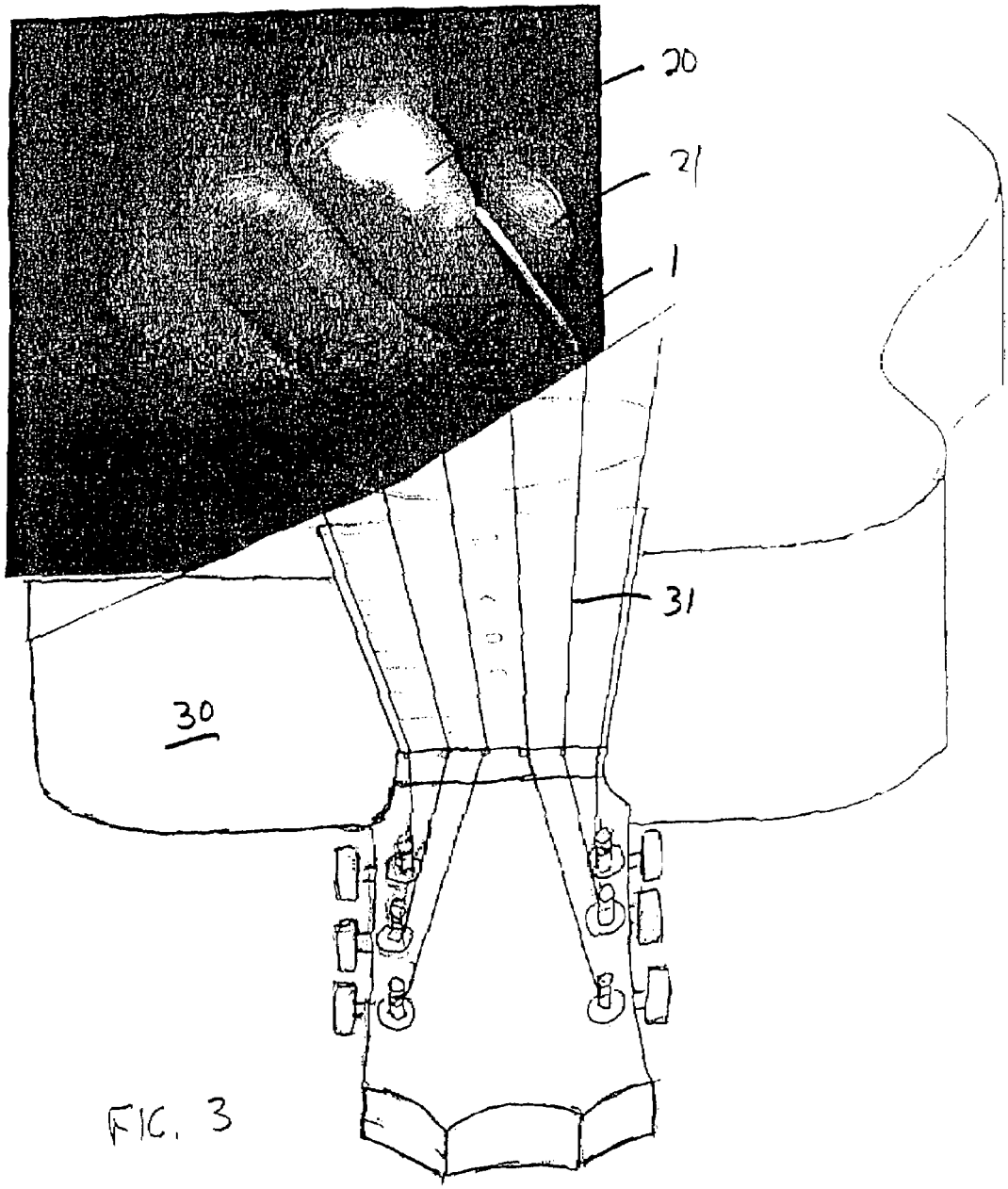
FIG. 3 is an illustration of a pick held by a musician and addressing a stringed instrument.
Figure 4:
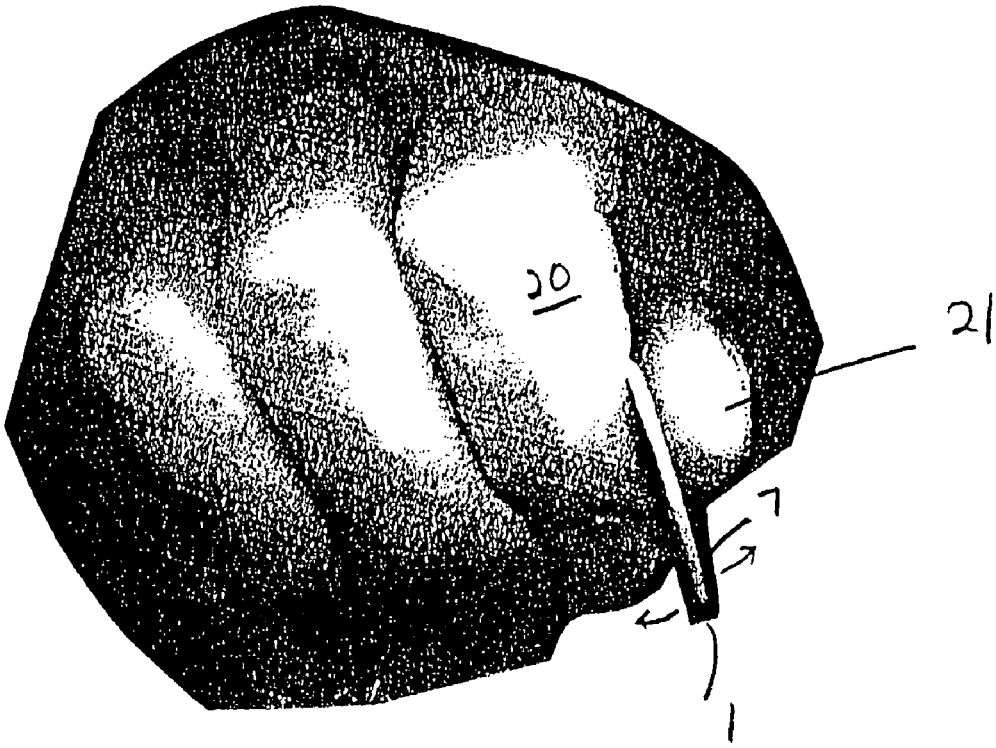
FIG. 4 is an illustration of a musician's hand holding a pick.
Figure 5:
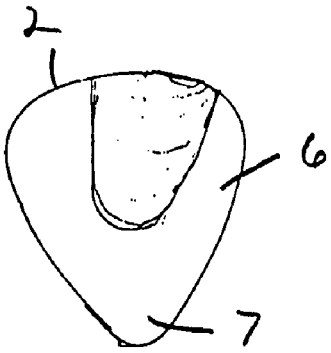
FIG. 5 illustrates the angle at which the index finger commonly contacts the rear or back surface of the pick.

As may be best seen from FIGS. 3-5, when a musician is actually holding a pick in preparation for striking the string 31 of a musical instrument 30, the pick longitudinal axis is not ninety degrees (perpendicular) to the plane of the strings 31. Also, the index finger 40 contacts the pick index finger gripping surface 15 at a variable angle, typically at about forty-five degrees. It would be helpful for some musicians, to modify the gripping surfaces 10, 15 to provide compensation for these striking and gripping angles. This is most easily done with the coating 8 of the present invention.

Figure 7:
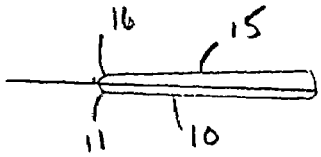
FIG. 7 is a side view of a pick embodiment with the index finger proximal end raised.
Figure 8:
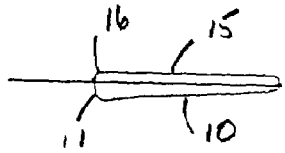
FIG. 8 is a side view of a pick embodiment with the thumb distal end raised.
Figure 9:
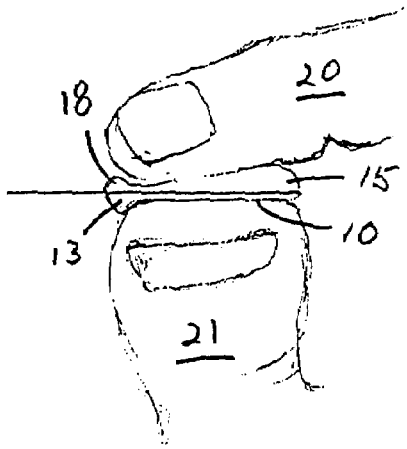
FIG. 9 is a side view of a pick embodiment with the index finger proximal end raised, index distal end ridged, and thumb distal end ridged.
Figure 10:
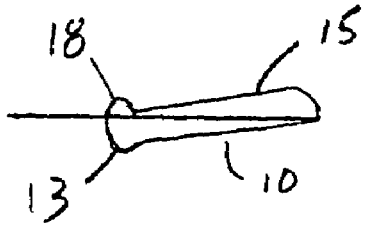
FIG. 10 is a side view of a pick embodiment combining the features of FIGS. 6 and 7.
Figure 11:
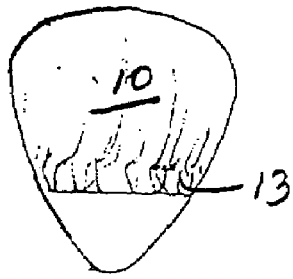
FIG. 11 is a thumb surface view of the pick of FIG. 8.
Figure 12:
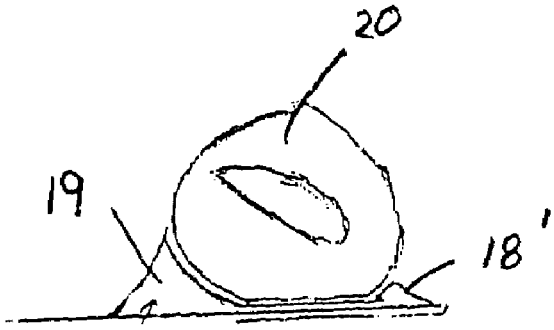
FIG. 12 is a side view of a pick embodiment with the index finger medial end or side ridged, and index finger medial end wedged.

Referring more particularly to FIGS. 7-12 there are shown different embodiments of the invention providing modifications to the shapes of the pick gripping surfaces 10, 15 for enhanced ability to grip and manipulate a pick 1. Applicant has found that the slightest change in surface contour can dramatically affect the performance and "feel" of the pick. FIG. 7 is a side view of a pick embodiment with the thickness of the index finger gripping surface 15 increasing in thickness from distal line 16 toward proximal line 17. In this example, the thumb gripping surface 10 has a uniform thickness. FIG. 8 is a side view of a pick embodiment with the thickness of the thumb gripping surface 10 increasing in thickness from proximal line 12 toward the distal line 11. In this embodiment, the index finger gripping surface 15 has a uniform thickness. FIG. 11 is a thumb surface view of the pick of FIG. 8. FIG. 9 is a side view of the pick embodiment of FIG. 7 with the following additions. A horizontal distal ridge 18 is added to the index finger gripping surface distal line 16. A horizontal distal ridge 13 is also added to the thumb gripping surface distal line 11. FIG. 10 is a side view of a pick embodiment combining the features of FIGS. 7 and 8. The index finger gripping surface 15 has an increasing thickness from distal line 16 toward proximal line 17. A horizontal distal ridge 18 is added to the index finger gripping surface distal line 16. The thumb gripping surface 10 has an increasing thickness from proximal line 12 toward the distal line 11. A horizontal distal ridge 13 is also added to the thumb gripping surface distal line 11. FIG. 12 is a side view of a pick embodiment with a generally flat index finger gripping surface 15. A ridge 18' is added to the lateral line 4. A wedge 19 is formed along the medial line 4.

There are many methods of gripping a pick. Some musicians might find that the added gripping ability of the coating on both gripping surfaces 10, 15 may be too much of a good thing thereby limiting the speed at which such a pick could be used while striking strings. For that reason, the coating of the present invention may include a variety of basically flat but textured picks that would work with any style of holding a pick. FIGS. 13-14 illustrate examples of textures which in effect reduce the contact surface area providing increased freedom to move a pick in a pivoting manner as shown in FIG. 4. FIG. 13A is a surface view of a pick with a textural embodiment comprising vertical ridges. FIG. 13B is a surface view of a pick with a textural embodiment comprising horizontal ridges. FIG. 13C is a surface view of a pick with a textural embodiment comprising dot elevations. FIG. 13D is a surface view of a pick with a textural embodiment comprising concentric circular ridges. FIG. 13E is a surface view of a pick with a tear drop shaped coating area which works well under the right thumb pad. FIG. 13F is a surface view of a pick with a U-shaped area of the coating which accommodates numerous finger(s) and thumb contact positions. FIG. 14 is a thumb gripping surface 10 with two vertical ridges 14.

Since there is so much variety in pick preferences, a flexible method of applying the coating 8 is provided by the present invention. The coating 8 is also provided in a "peel and stick" applique format which can be applied to almost any conventional pick to provide the pick the desired properties as described above. The coating 8 with an added underside adhesive would be peeled off of a non-stick paper, plastic or other surface, and pressed onto a pick. If desired, the coating could first be cut or shaped and then applied as desired by the musician. Applicant has also found that a double-sided adhesive tape can be effective. One side of the tape is attached directly to a pick surface, and the other side of the tape provides the musician with a tacky gripping surface.

It is understood that the above-described embodiment is merely illustrative of the application. Other embodiments may be readily devised by those skilled in the art which will embody the principles of the invention and fall within the spirit and scope thereof.

I claim:

1. A musical instrument pick, comprising:

a top edge;

a bottom edge, said top edge and bottom edge defining a pick longitudinal axis;

two opposite side edges, said opposite side edges tapering toward the bottom edge at an acute angle forming a pick tip, said opposite side edges expanding toward the top edge at an obtuse angle;

a flat front surface;

an opposite flat rear surface; and a synthetic polymer adhesive coating on the front and rear surfaces, said coated surface portions referred to as the thumb gripping surface and the finger gripping surface, respectively;

wherein:

the thumb gripping surface extends horizontally from side edge to side edge, and vertically from a distal horizontal line adjacent the pick tip to a proximal line at the pick top edge; and the finger gripping surface extends horizontally from side edge to side edge, and vertically from a distal horizontal line adjacent the pick tip to a proximal line at the sick top edge;

wherein:

said coating on said finger gripping surface increases in thickness from said finger gripping surface distal line toward said index finger gripping surface proximal line; and said coating on said thumb gripping surface has a uniform thickness.

2. A musical instrument pick as recited in claim 1, further comprising:

a horizontal distal ridge at the index finger gripping surface distal line; and a horizontal distal ridge at the thumb gripping surface distal line.

3. A musical instrument pick, comprising:

a top edge;

a bottom edge, said top edge and bottom edge defining a sick longitudinal axis;

two opposite side edges, said opposite side edges tapering toward the bottom edge at an acute angle forming a pick tip, said opposite side edges expanding toward the top edge at an obtuse angle;

a flat front surface;

an opposite flat rear surface; and a synthetic polymer adhesive coating on the front and rear surfaces, said coated surface portions referred to as the thumb gripping surface and the finger gripping surface, respectively;

wherein:

the thumb gripping surface extends horizontally from side edge to side edge, and vertically from a distal horizontal line adjacent the pick tip to a proximal line at the pick top edge; and the finger gripping surface extends horizontally from side edge to side edge, and vertically from a distal horizontal line adjacent the sick tip to a proximal line at the pick top edge;

wherein:

said coating on said finger gripping surface has a uniform thickness;

said coating on said thumb gripping surface increases in thickness from said thumb gripping surface proximal line toward the thumb gripping surface distal line.

4. A musical instrument pick, comprising:

a top edge;

a bottom edge, said top edge and bottom edge defining a pick longitudinal axis;

two opposite side edges, said opposite side edges tapering toward the bottom edge at an acute angle forming a pick tip, said opposite side edges expanding toward the top edge at an obtuse angle;

a flat front surface;

an opposite flat rear surface; and a synthetic polymer adhesive coating on the front and rear surfaces, said coated surface portions referred to as the thumb gripping surface and the finger gripping surface, respectively;

wherein:

the thumb gripping surface extends horizontally from side edge to side edge, and vertically from a distal horizontal line adjacent the sick tip to a proximal line at the pick top edge; and the finger gripping surface extends horizontally from side edge to side edge, and vertically from a distal horizontal line adjacent the pick tip to a proximal line at the pick top edge;

wherein:

said coating on said finger gripping surface increases in thickness from said finger gripping surface distal line toward said finger gripping surface proximal line; and said coating on said thumb gripping surface increases in thickness from said thumb gripping surface proximal line toward the thumb gripping surface distal line.

5. A musical instrument pick as recited in claim 4, further comprising:

a horizontal distal ridge at the index finger gripping surface distal line; and a horizontal distal ridge at the thumb gripping surface distal line.

6. A musical instrument pick, comprising:

a top edge;

a bottom edge, said top edge and bottom edge defining a pick longitudinal axis;

two opposite side edges, said opposite side edges tapering toward the bottom edge at an acute angle forming a pick tip, said opposite side edges expanding toward the top edge at an obtuse angle;

a flat front surface;

an opposite flat rear surface; and a synthetic polymer adhesive coating on the front and rear surfaces, said coated surface portions referred to as the thumb gripping surface and the finger gripping surface, respectively;

wherein the synthetic polymer adhesive is an acrylic adhesive;

wherein the synthetic polymer adhesive is a siliconized acrylic adhesive.

7. A musical instrument pick as recited in claim 6, wherein:

said synthetic polymer adhesive has a silicone elastomer.

8. A musical instrument pick, comprising:

a top edge;

a bottom edge, said top edge and bottom edge defining a pick longitudinal axis;

two opposite side edges, said opposite side edges tapering toward the bottom edge at an acute angle forming a pick tip, said opposite side edges expanding toward the top edge at an obtuse angle;

a flat front surface;

an opposite flat rear surface; and a synthetic polymer adhesive applique coating, said applique coating adapted to be peeled off of a non-stick paper and pressed onto the front and rear surfaces;

wherein the synthetic polymer adhesive is a siliconized acrylic adhesive.

9. A musical instrument pick, comprising:

a top edge;

a bottom edge, said top edge and bottom edge defining a pick longitudinal axis;

two opposite side edges, said opposite side edge tapering toward the bottom edge at an acute angle forming a pick tip, said opposite side edges expanding toward the top edge at an obtuse angle;

a flat front surface;

an opposite flat rear surface; and a synthetic polymer adhesive double sided tape, said tape adapted to be pressed onto the front and rear surfaces;

wherein the synthetic polymer adhesive is a siliconized acrylic adhesive.

* * * * *